US009812802B2

(12) United States Patent
Terajima et al.

(10) Patent No.: US 9,812,802 B2
(45) Date of Patent: Nov. 7, 2017

(54) ELECTRICAL TERMINAL HAVING A CONTACT MADE OF A FIRST METAL AND A COUPLING MEMBER OF A SECOND METAL

(71) Applicant: Tyco Electronics Japan G.K., Kanagawa (JP)

(72) Inventors: Keita Terajima, Kanagawa (JP); Masaaki Harasawa, Kanagawa (JP)

(73) Assignee: Tyco Electronics Japan G.K., Kanagawa (JP)

( * ) Notice: Subject to any disclaimer, the term of this patent is extended or adjusted under 35 U.S.C. 154(b) by 0 days.

(21) Appl. No.: 15/225,930

(22) Filed: Aug. 2, 2016

(65) Prior Publication Data

US 2017/0040727 A1 Feb. 9, 2017

(30) Foreign Application Priority Data

Aug. 4, 2015 (JP) ..... 2015-154091

(51) Int. Cl.
*H01R 4/10* (2006.01)
*H01R 13/03* (2006.01)
(Continued)

(52) U.S. Cl.
CPC ..... *H01R 13/03* (2013.01); *H01R 4/023* (2013.01); *H01R 4/184* (2013.01); *H01R 4/185* (2013.01); *H01R 4/62* (2013.01); *H01R 13/052* (2013.01); *H01R 13/055* (2013.01); *H01R 13/113* (2013.01); *H01R 24/20* (2013.01); *H01R 24/28* (2013.01); *H01R 2101/00* (2013.01)

(58) Field of Classification Search
CPC ..... H01R 4/023; H01R 4/18; H01R 4/185; H01R 4/188; H01R 4/62; H01R 13/03; H01R 13/05; H01R 13/052; H01R 13/055; H01R 13/6275; H01R 13/6582; H01R 4/184; H01R 13/113; H01R 13/6282; H01R 24/20; H01R 24/28
USPC ..... 439/352, 442, 852, 877, 879, 284
See application file for complete search history.

(56) References Cited

U.S. PATENT DOCUMENTS 5,593,328 A * 1/1997 Okada ..... H01R 13/11 439/843
7,556,541 B2 * 7/2009 Tyler ..... H01R 13/03 439/843
(Continued)

FOREIGN PATENT DOCUMENTS

JP 56720 U 1/1993
JP 3000834 U 6/1994
(Continued)

OTHER PUBLICATIONS

English Translation of WO 2013161551 Oct. 31, 2013, 14 pages.*
(Continued)

*Primary Examiner* — Chandrika Prasad
(74) *Attorney, Agent, or Firm* — Barley Snyder

(57) ABSTRACT

An electrical terminal is disclosed. The electrical terminal has a first contact made of a first metal and a coupling member made of a metal fixed to the first contact. The coupling member has a cantilever extending along the first contact with a free end extending toward the first contact. The cantilever presses a second contact made of the first metal against the first contact.

19 Claims, 7 Drawing Sheets

(51) Int. Cl.

| | |
|---|---|
| ***H01R 4/18*** | (2006.01) |
| ***H01R 4/62*** | (2006.01) |
| ***H01R 13/11*** | (2006.01) |
| ***H01R 4/02*** | (2006.01) |
| ***H01R 13/05*** | (2006.01) |
| ***H01R 24/20*** | (2011.01) |
| ***H01R 24/28*** | (2011.01) |
| *H01R 101/00* | (2006.01) |

(56) References Cited

U.S. PATENT DOCUMENTS

| | | | | |
|---|---|---|---|---|
| 7,918,695 | B2 * | 4/2011 | Kutsuna | H01R 13/187 439/845 |
| 2002/0132507 | A1 * | 9/2002 | Maeda | H01R 13/28 439/284 |
| 2010/0035487 | A1 * | 2/2010 | Nakagawa | H01R 4/184 439/877 |
| 2013/0210255 | A1 * | 8/2013 | Uchiyama | H01R 13/52 439/271 |
| 2014/0087607 | A1 * | 3/2014 | Kojima | H01R 13/04 439/891 |
| 2015/0244084 | A1 * | 8/2015 | Aizawa | H01R 4/185 439/878 |
| 2016/0006164 | A1 * | 1/2016 | Sato | H01R 4/185 439/587 |
| 2017/0040726 | A1 * | 2/2017 | Terajima | H01R 13/03 |

FOREIGN PATENT DOCUMENTS

| | | | |
|---|---|---|---|
| JP | 71578 | U | 1/1995 |
| JP | 200226399 | A | 1/2002 |
| WO | 2013161551 | * | 10/2013 |
| WO | 2013161551 | A1 | 10/2013 |

OTHER PUBLICATIONS

European search report, dated Dec. 5, 2016, 7 pages.
Machine translation of WO2013/161551, dated Oct. 31, 2013, 14 pages.

* cited by examiner

ELECTRICAL TERMINAL HAVING A CONTACT MADE OF A FIRST METAL AND A COUPLING MEMBER OF A SECOND METAL

CROSS-REFERENCE TO RELATED APPLICATION

This application claims the benefit of the filing date under 35 U.S.C. §119(a)-(d) of Japanese Patent Application No. 2015-154091, filed Aug. 4, 2015.

FIELD OF THE INVENTION

The present invention relates to an electrical terminal, and more particularly, to an electrical terminal of a thermocouple.

BACKGROUND

In a known thermocouple, a first end of each of two kinds of metal wires, for example, alumel and chromel, are connected to one another. The thermocouple measures the thermoelectromotive force occurring between two opposite second ends. Interposition of a different kind of metal, such as copper, between the second ends and a measuring device causes a measurement error. Known thermocouples thus use an alumel lead wire to connect the alumel wire to the measuring device, and a chromel lead wire to connect the chromel wire to the measuring device.

Japanese Patent Application Laid-Open No. 2002-26399 ("JP 2002-26399") and Japanese Utility Model Application Laid-Open No. H05-6720 ("JP H05-6720") both disclose connectors connecting a compensating lead wire made of the same kind of metal to a metal wire constituting a thermocouple. JP 2002-26399 discloses a thermocouple connector having a pin-side connector with an electrode pin biased by a coil spring and an end face-side connector having an electrode end face. However, in JP 2002-26399, in order to maintain connection between the pin-side connector and the end face-side connector, a lock mechanism is additionally required, and the structure of the connector is complicated to manufacture. JP H05-6720 discloses a thermocouple connector having a plug terminal and a socket terminal with a flat spring member including a bimetal structure. A contact pressure between the plug terminal and the socket terminal may fluctuate with temperature, causing a measurement error. Further, some metals used for thermocouples, such as alumel, chromel, or constantan, have poor ductility, malleability, or elasticity, and are unsuitable in themselves as electrical terminal materials.

SUMMARY

An object of the invention, among others, is to provide an electrical terminal with a structure directly connecting metal materials that are otherwise unsuitable as electrical terminal materials. The disclosed electrical terminal has a first contact made of a first metal and a coupling member made of a second metal fixed to the first contact. The coupling member has a cantilever extending along the first contact with a free end extending toward the first contact. The cantilever presses a second contact made of the first metal against the first contact.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of an electrical terminal. This invention may, however, be embodied in many different forms and should not be construed as limited to the embodiments set forth herein; rather, these embodiments are provided so that this disclosure will be thorough and complete and still fully convey the scope of the invention to those skilled in the art.

An electrical terminal 10 according to the invention is shown generally in FIGS. 1-5. The electrical terminal 10 has a contact 20 and a coupling member 30. The major components of the invention will now be described in greater detail.

Figure 1:
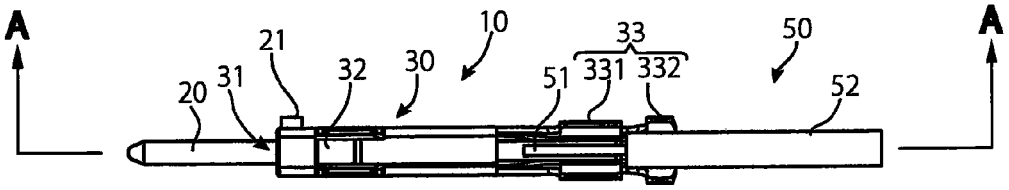
FIG. 1 is a top view of an electrical terminal according to the invention.
Figure 2:
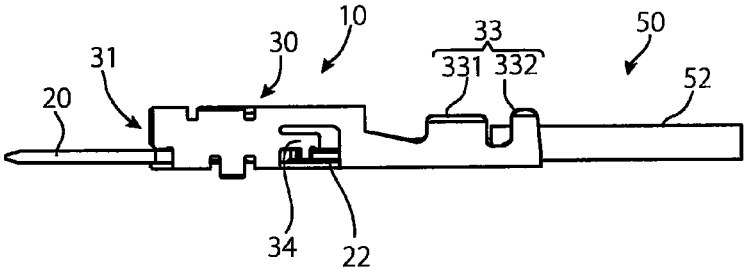
FIG. 2 is a right side view of the electrical terminal of FIG. 1.
Figure 3:
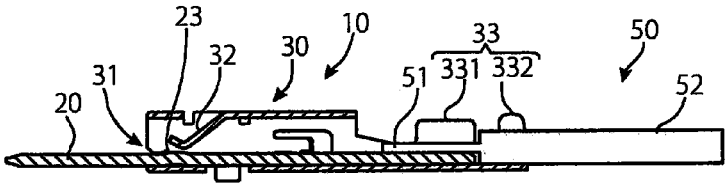
FIG. 3 is a sectional view taken along arrow A-A shown in FIG. 1.

The contact 20, as shown in FIGS. 1-3, has an elongated shape tapered at a first end. In the shown embodiment, the contact 20 has an elongated rectangular shape, but the contact 20 could alternatively have a circular, rod-like shape.

The contact 20 is made of the same metal material as the material of the wire is it used to connect, for example, a contact 20 for an alumel thermocouple wire is made of alumel, and a contact for a chromel thermocouple wire is made of chromel. The contacts 20 are described herein as formed from alumel or chromel. However, metal materials constituting a thermocouple are not limited to alumel and chromel. The contacts 20 may alternatively be formed of a different metal material such as constantan, nicrosil, nisil, iron, platinum, platinum-rhodium alloy, iridium, iridium-rhodium alloy, tungsten-rhenium alloy, nichrome, gold-iron alloy, nickel, nickel-molybdenum alloy, palladium-platinum-gold alloy, gold-palladium alloy, gold-cobalt alloy, or similar thermocouple metals known to those with ordinary skill in the art.

The contact 20 has a projection 21, a catch 22, and a contact point 23.

As shown in FIG. 1, the projection 21 projects from one side face of the contact 20. The particular side from which the projection 21 projects indicates the type of material of the contact 20; if the projection 21 is positioned on the left side when the electrical terminal 10 shown is viewed from the front, the contact 20 of the electrical terminal 10 is either alumel and chromel, and if the projection 21 is positioned on the right side, the contact 20 of the electrical terminal 10 is the other of alumel and chromel. The projection 21 further functions as a key preventing false insertion when the electrical terminal 10 is inserted into a housing (not shown).

Figure 4:
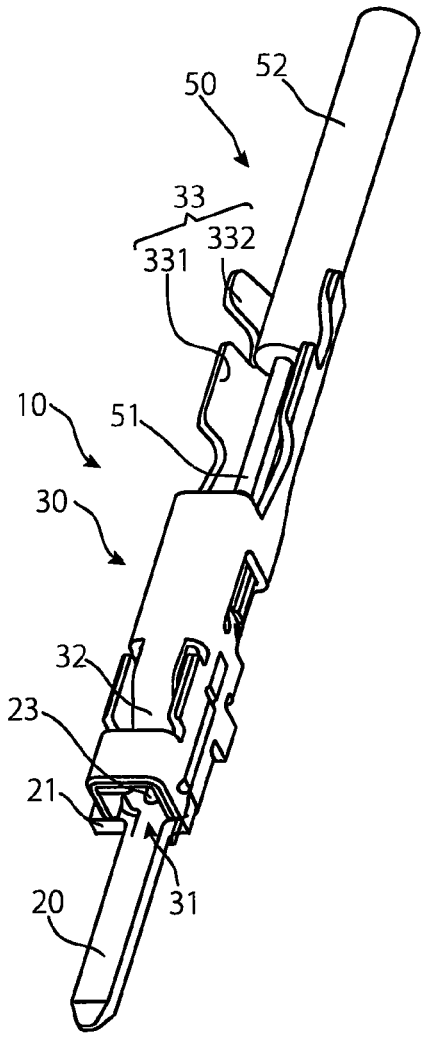
FIG. 4 is an isometric view of the electrical terminal of FIG. 1 in a pre-crimped position.

The catch 22, shown in FIG. 2, is disposed approximately centrally on a side of the contact 20. The contact point 23, shown in FIGS. 3 and 4, is embossed from the bottom face side of contact 20 so as to project upward.

The coupling member 30, as shown in FIGS. 1-3, has a substantially-rectangular sectional shape. In the shown embodiment, the coupling member 30 is made of a copper alloy, but one with ordinary skill in the art would understand that the coupling member 30 could be made of other conductive materials. The coupling member 30 has an insertion opening 31, a spring 32, a crimping portion 33, and a latch 34.

The insertion opening 31 extends into a front end of the coupling member 30.

The spring 32 is formed in a cantilever-like shape, a rear end thereof is a fixed end and a front end thereof is a free end. The fixed end of the spring 32, as shown in FIG. 3, is attached to a top wall of the coupling member 30, and the free end of the spring 32 extends into an interior of the coupling member 30 adjacent the insertion opening 31.

The crimping portion 33 has a core crimping portion 331 and a sheath crimping portion 332. The sheath crimping portion 332 is disposed on a rear end of the coupling member 30 and the core crimping portion 331 is disposed along a length of the coupling member 30 toward a center of the coupling member 30, adjacent the sheath crimping portion 332. Both the core crimping portion 331 and the sheath crimping portion 332 have an open-top, substantially-U sectional shape.

The latch 34, as shown in FIG. 2, is disposed approximately centrally along a side of the coupling member 30.

The assembly of the electrical terminal 10 will now be described with reference to FIGS. 1-4.

The contact 20 extends into the insertion opening 31. A rear end portion of the contact 20 extends to the core crimping portion 331, as shown in FIG. 3, and a front end portion of the contact 20 extends outward from the insertion opening 31. In the shown embodiment, the coupling member 30 is fixed to the contact 20 by spot welding. The coupling member 30 is alternatively fixed to the contact 20 by swaging, or could be fixed to the contact 20 by other types of fixed attachments known to those with ordinary skill in the art.

The latch 34 engages with the catch 22, thereby preventing the contact 20 from forwardly disconnecting from the coupling member 30. The spring 32 extends frontward and rearward along the contact 20, with the free end of the spring 32 extending toward the contact 20.

The use of the electrical terminal 10 will now be described with reference to FIGS. 1-5. In FIGS. 1-5, a compensating lead wire 50 is shown in addition to the electrical terminal 10.

The electrical terminal 10 electrically connects a thermocouple (not shown) and a measuring device (not shown). The thermocouple uses two kinds of metal electrical wires, for example, alumel and chromel. The wires constituting the thermocouple are connected to a compensating lead wire 50 formed of the same material via the electrical terminal 10 having a structure shown herein, and led to the measuring device (not shown) by the compensating lead wire 50.

The compensating lead wire 50 is inserted into the electrical terminal 10 in a pre-crimped position shown in FIGS. 1-4. The compensating lead wire 50 has a core 51 and a sheath 52 covering the core 51. The core 51 is made of alumel or chromel. The compensating lead wire 50 having the alumel core 51 is crimped and fixed to the electrical terminal 10 having the alumel contact 20. Similarly, the compensating lead wire 50 having the chromel core 51 is crimped and fixed to the electrical terminal 10 having the chromel contact 20.

Figure 5:
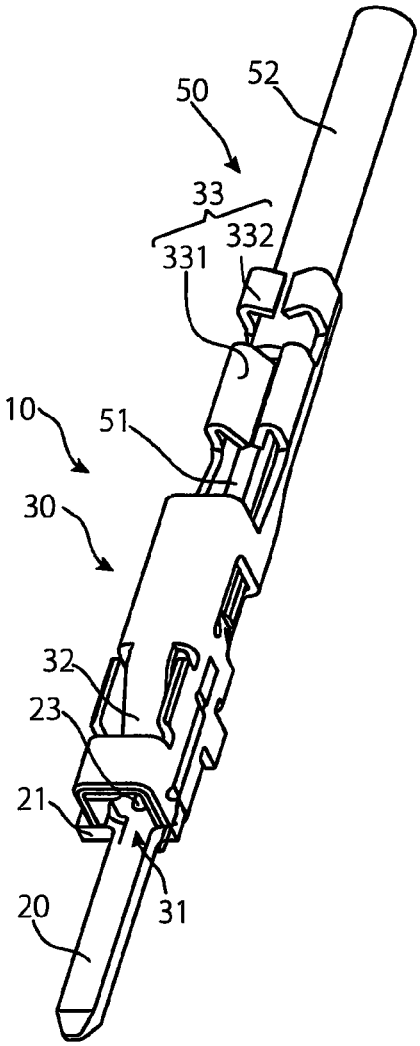
FIG. 5 is an isometric view of the electrical terminal of FIG. 1 crimped to a compensating lead wire.

As shown in FIGS. 4 and 5, the compensating lead wire 50 is crimped and fixed to the electrical terminal 10 by the crimping portion 33.

The core 51 is stripped by removing the sheath 52 at a distal end portion of the compensating lead wire 50. Then, the stripped core 51 is disposed in the core crimping portion 331 as shown in FIG. 4. The core 51 comes into direct contact with the contact 20 in the core crimping portion 331, as best shown in FIG. 3.

When the stripped core 51 is placed in the core crimping portion 331, a portion of the compensating lead wire 50 therebehind where the core 51 is covered with the sheath 52 is disposed in the sheath crimping portion 332. Since the contact 20 extends to the core crimping portion 331, but not to the sheath crimping portion 332, the core 51 is placed in a higher position than a lower face of the sheath 52 by the thickness of the contact 20, as shown in FIG. 3. The thickness of the contact 20 is adjusted so that the core 51 is located at a center of a cross-section of the compensating lead wire 50 even after crimping.

The crimping portion 33 is then crimped, as shown in FIG. 5, with the core crimping portion 331 crimped to the core 51 and the sheath crimping portion 332 crimped to the sheath 52. In the core crimping portion 331, the core 51 is directly pressed against and electrically connected to the contact 20. In the sheath crimping portion 332, the compensating lead wire 50 is firmly fixed to the electrical terminal 10. Thus, even if unintentional force is applied to the compensating lead wire 50 in the crimped state, the force is not transmitted to the core 51 within the core crimping portion 331, since the compensating lead wire 50 is crimped and fixed in the sheath crimping portion 332. Connection between the core 51 and the contact 20 formed of the same metal material is stably maintained.

Figure 8:
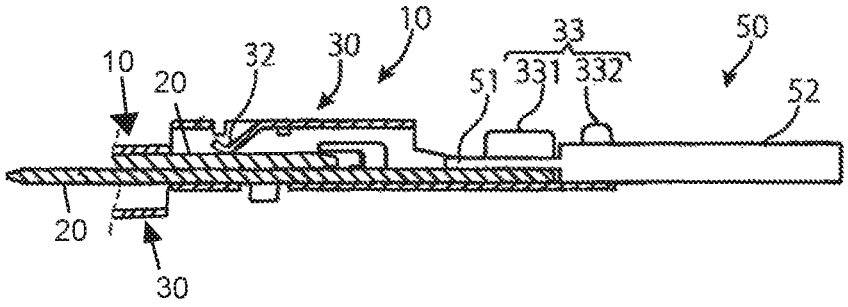
FIG. 8 is a sectional view of the electrical terminal of FIG. 1 mated with an identical electrical terminal.

The electrical terminal 10 crimped to the compensating lead wire 50, as shown in FIG. 8, mates with a mating electrical terminal 10 formed identically to the electrical terminal 10 such that the mating electrical terminal 10 has a mating contact 20 and a mating coupling member 30 having a mating spring and a mating crimping portion crimped to a wire such as an alumel or chromel wire. The alumel wire and the chromel wire constituting the thermocouple both have the same structures and the same dimensions as the compensating lead wire 50 shown in FIGS. 1-5. Therefore, the alumel wire and the chromel wire constituting the thermocouple and the compensating lead wire 50 connecting the thermocouple and the measuring device may be both referred to as compensating lead wire 50 without discrimination. Further, the mating electrical terminal 10 is crimped to the alumel or chromel wire just as the electrical terminal 10 is crimped to the compensating lead wire 50.

The mating contact and wire formed of the mating electrical terminal 10 are formed of the same material as the contact 20 and compensating lead wire 50 of the electrical terminal 10 to which it mates. When the contact 20 and compensating lead wire 50 of the electrical terminal 10 is made, for example, of alumel, the mating electrical terminal 10 has a mating contact and a wire made of alumel. Similarly, when the contact 20 and compensating lead wire 50 of the electrical terminal 10 is made of chromel, the mating contact and wire of the mating electrical terminal 10 is also made of chromel.

In mating the electrical terminal 10 and the mating electrical terminal 10 with each other, as shown in FIG. 8, the mating electrical terminal 10 is turned upside down with respect to the electrical terminal 10, and the mating contact 20 of the mating electrical terminal 10 is inserted through the insertion opening 31 of the electrical terminal 10. The mating contact 20 of the mating electrical terminal 10, as shown in FIG. 8, is held between the contact 20 and the spring 32. The spring 32, by virtue of being formed from a copper alloy, is elastic and presses the mating contact 20 against the contact 20 with a predetermined contact pressure. The contact 20 of the electrical terminal 10 is also pressed against the mating contact 20 by a mating spring of the mating electrical terminal 10. In this manner, an alumel or chromel wire is electrically connected to an alumel or chromel compensating lead wire 50 by a respective alumel or chromel mating contact and a respective alumel or chromel contact 20. The alumel or chromel wire is thus electrically connected to the alumel or chromel compensating lead wire 50 without interposition of a different metal material.

Figure 6:
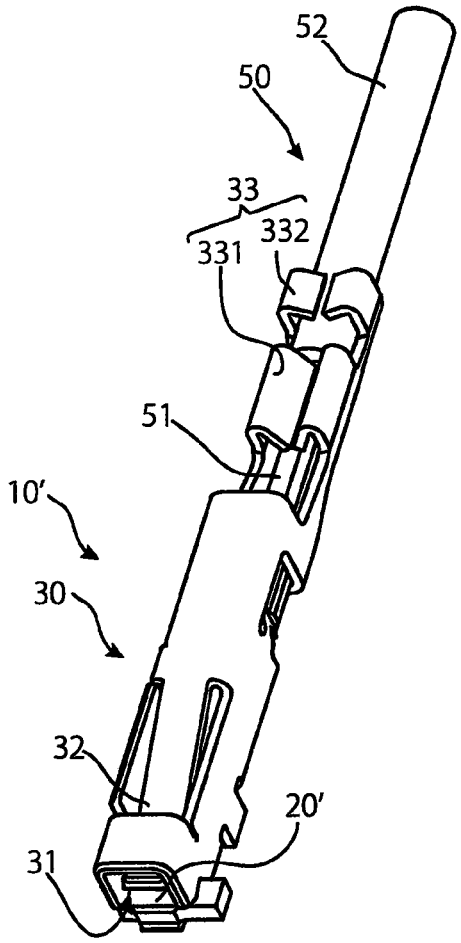
FIG. 6 is an isometric view of an electrical terminal according to another embodiment of the invention.

An electrical terminal 10' according to another embodiment of the invention is shown in FIG. 6. Like reference numbers indicate like components with respect to the electrical terminal 10 shown in FIGS. 1-5, and only differences will be described herein. In the electrical terminal 10, the contact 20 projects frontward beyond the insertion opening 31. In contrast, in the electrical terminal 10' shown in FIG. 6, a contact 20' thereof extends only to a position aligned with the front end of the coupling member 30. In the case of the electrical terminal 10', the contact 20' does not extend into a mating electrical terminal 10. The electrical terminal 10' receives the mating contact 20, which is pressed against the contact 20' of the electrical terminal 10' by the spring 32 of the electrical terminal 10', as similarly shown in FIG. 8, and the contacts 20, 20' are thus connected together.

Figure 7:
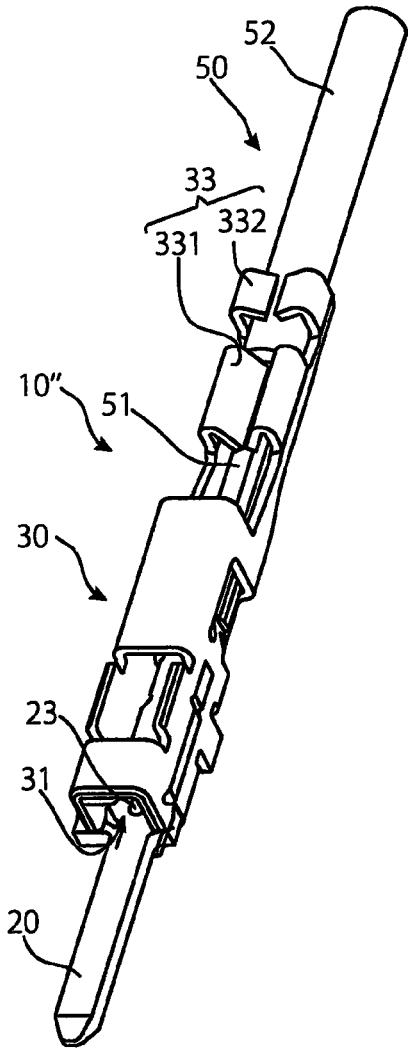
FIG. 7 is an isometric view of a mating electrical terminal mating with the electrical terminal of FIG. 6.
Figure 9:
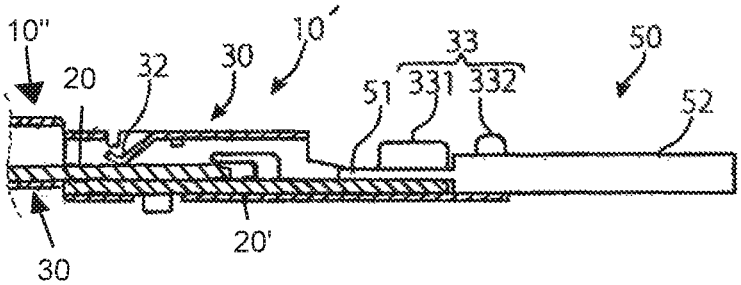
FIG. 9 is a sectional view of the electrical terminal of FIG. 6 mated with the mating electrical terminal of FIG. 7.

An electrical terminal 10" according to another embodiment of the invention is shown in FIG. 7. Like reference numbers indicate like components with respect to the electrical terminal 10 shown in FIGS. 1-5, and only differences will be described herein. The electrical terminal 10", as shown in FIG. 9, is used as a mating electrical terminal mating with the electrical terminal 10' shown in FIG. 6. The mating electrical terminal 10", as compared with the electrical terminal 10, has a shape obtained by removing the spring 32 from the coupling member 30 of the electrical terminal 10, since the contact 20' of electrical terminal 10' does not extend into mating electrical terminal 10" as shown in FIG. 9. Similarly to the mating of the terminals 10, 10 described above, the mating contact 20 of the mating electrical terminal 10", as shown in FIG. 9, is inserted through the insertion opening 31 of the electrical terminal 10' and is held between the contact 20' and the spring 32, the spring 32 pressing the mating contact 20 against the contact 20'.

An electrical terminal 10-10" for a thermocouple has been described by way of example, however, a scope of application of the present invention is not limited to a thermocouple. For example, many contacts are made from pure copper in order to flow a high current. Pure copper, however, is so soft that it cannot constitute an electrical terminal by itself. Consequently, an electrical terminal 10-10" may alternatively be used to adapt an electrical connection of a contact made of pure copper.

Advantageously, according to the electrical terminals 10-10" of the present invention, even metal materials unsuitable as electrical terminal materials can be directly and reliably connected together. The present invention is thus widely applicable when electrical signal transmission or power transmission is required to be performed using a metal material which cannot form an electrical terminal by itself. Specifically, when the electrical terminal 10 is used with an identical mating electrical terminal, an alumel wire or a chromel wire of a thermocouple can be extended to a measuring device via the electrical terminal 10 using an electrical wire made of the same material without interposition of a different metal. The material for the core 51, which is alumel, chromel, or the like, is brittle and not a material appropriate for crimping. The coupling member 30 of electrical terminals 10-10", however, is made of a suitable crimping material, and can reliably fix and electrically connect the brittle core 51 to the contact 20.

What is claimed is:

1. An electrical terminal, comprising:

a first contact made of a first metal; and a coupling member made of a second metal fixed to the first contact, the coupling member having a cantilever with a free end extending toward the first contact, the cantilever pressing a second contact made of the first metal and fixed to a mating electrical terminal against the first contact, the second contact disposed between the cantilever and the first contact.

2. The electrical terminal of claim 1, wherein the mating electrical terminal is formed identically to the electrical terminal.

3. The electrical terminal of claim 1, wherein the coupling member is fixed to the first contact by spot welding or swaging.

4. The electrical terminal of claim 1, wherein the first contact has an elongated rectangular shape or a rod-like shape.

5. The electrical terminal of claim 4, wherein the first contact has a projection extending from a side face of the first contact.

6. The electrical terminal of claim 4, wherein the first contact has a catch disposed approximately centrally on a side of the first contact.

7. The electrical terminal of claim 6, wherein the coupling member has a latch disposed approximately centrally on a side of the coupling member engaging the catch.

8. The electrical terminal of claim 1, wherein the coupling member has a crimping portion crimped to press the first contact against an electrical wire made of the first metal.

9. The electrical terminal of claim 8, wherein the coupling member is fixed to the first contact independently of crimping at the crimping portion.

10. The electrical terminal of claim 9, wherein the coupling member has a sheath crimping portion disposed on a rear end of the coupling member.

11. The electrical terminal of claim 10, wherein the coupling member has a core crimping portion disposed adjacent the sheath crimping portion.

12. The electrical terminal of claim 11, wherein the sheath crimping portion is crimped to a sheath of the electrical wire.

13. The electrical terminal of claim 12, wherein the core crimping portion is crimped to a core of the electrical wire.

14. The electrical terminal of claim 1, wherein a front end of the first contact extends from a front end of the coupling member.

15. The electrical terminal of claim 1, wherein a front end of the first contact is aligned with a front end of the coupling member in a direction perpendicular to a longitudinal direction of the electrical terminal.

16. The electrical terminal of claim 1, wherein the first metal is alumel or chromel.

17. The electrical terminal of claim 16, wherein the second metal is a copper alloy.

18. The electrical terminal of claim 1, wherein the cantilever extends from a top wall of the coupling member and the first contact is disposed along an opposite bottom wall of the coupling member.

19. The electrical terminal of claim 18, wherein the cantilever directly abuts the second contact.

* * * * *